US007958760B2

(12) United States Patent
Widén

(10) Patent No.: US 7,958,760 B2
(45) Date of Patent: Jun. 14, 2011

(54) LOCK AND KEY SYSTEM WITH IMPROVED TUMBLERS IN THE LOCK

(75) Inventor: Bo Widén, Torshälla (SE)

(73) Assignee: Winloc AG, Zug Schweiz (CH)

( * ) Notice: Subject to any disclaimer, the term of this patent is extended or adjusted under 35 U.S.C. 154(b) by 0 days.

(21) Appl. No.: 11/294,405

(22) Filed: Dec. 6, 2005

(65) Prior Publication Data

US 2007/0028658 A1 Feb. 8, 2007

(30) Foreign Application Priority Data

Aug. 5, 2005 (SE) ..... 0501782

(51) Int. Cl.
*E05B 15/14* (2006.01)
*E05B 27/00* (2006.01)

(52) U.S. Cl. ..... 70/378; 70/392; 70/493

(58) Field of Classification Search ..... 70/348, 70/376, 378, 392, 490–494
See application file for complete search history.

(56) References Cited

U.S. PATENT DOCUMENTS

| | | | | |
|---|---|---|---|---|
| 588,026 | A | 8/1897 | Stadtmuller | |
| 4,235,086 | A * | 11/1980 | Genakis | 70/494 |
| 4,325,241 | A | 4/1982 | Keller | |
| 4,409,807 | A * | 10/1983 | Lipschutz | 70/493 |
| 4,635,455 | A * | 1/1987 | Oliver | 70/494 |
| 4,756,177 | A * | 7/1988 | Widen | 70/493 |
| 4,998,426 | A * | 3/1991 | Genakis | 70/494 |
| 5,101,648 | A | 4/1992 | Kuster | |
| 5,419,168 | A * | 5/1995 | Field | 70/494 |
| 5,943,890 | A * | 8/1999 | Field et al. | 70/493 |
| 6,257,033 | B1 * | 7/2001 | Ziv-Av | 70/494 |
| 7,181,941 | B2 * | 2/2007 | Eden, Jr. | 70/493 |
| 7,392,676 | B2 * | 7/2008 | Eden, Jr. | 70/493 |
| 2004/0237614 | A1 | 12/2004 | Ketzler et al. | |
| 2006/0086164 | A1 * | 4/2006 | Keller | 70/493 |

FOREIGN PATENT DOCUMENTS

| | | | |
|---|---|---|---|
| DE | 42 28 098 | C1 | 11/1993 |
| DE | 44 19 999 | A1 | 12/1995 |
| GB | 945792 | | 1/1964 |
| WO | WO-03/062570 | A1 | 7/2003 |

* cited by examiner

*Primary Examiner* — Suzanne D Barrett
*Assistant Examiner* — Christopher Boswell
(74) *Attorney, Agent, or Firm* — Birch, Stewart, Kolasch & Birch, LLP

(57) ABSTRACT

A lock and key system is disclosed including locks of the kind comprising a cylindrical key plug (203) with locking tumblers (205) having a body part (206*a*) and an integral key sensing part (206*b*) for engagement with an associated key (100). The key sensing part (206*b*) of each locking tumbler comprises at least two neighbouring key contacting portions (210*a*, 211*a*), confined within a limited region, for possible sliding engagement with a longitudinal code pattern of the associated key, at least one but not necessarily all of these key contacting portions of each locking tumbler actually engaging with a corresponding code portion of the associated key upon fully inserting the latter into the key slot of the lock.

35 Claims, 14 Drawing Sheets

Fig 9
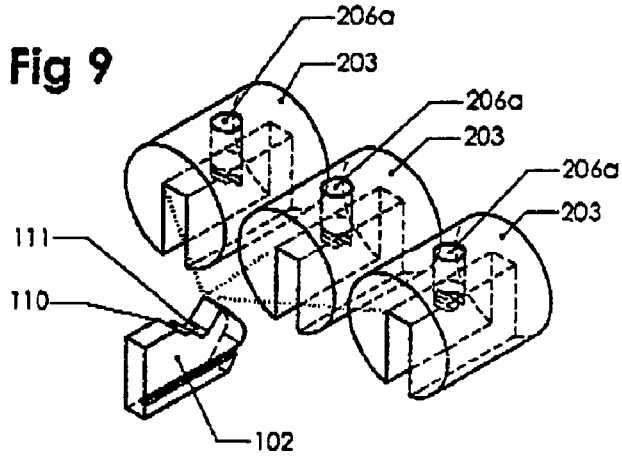
Fig 10
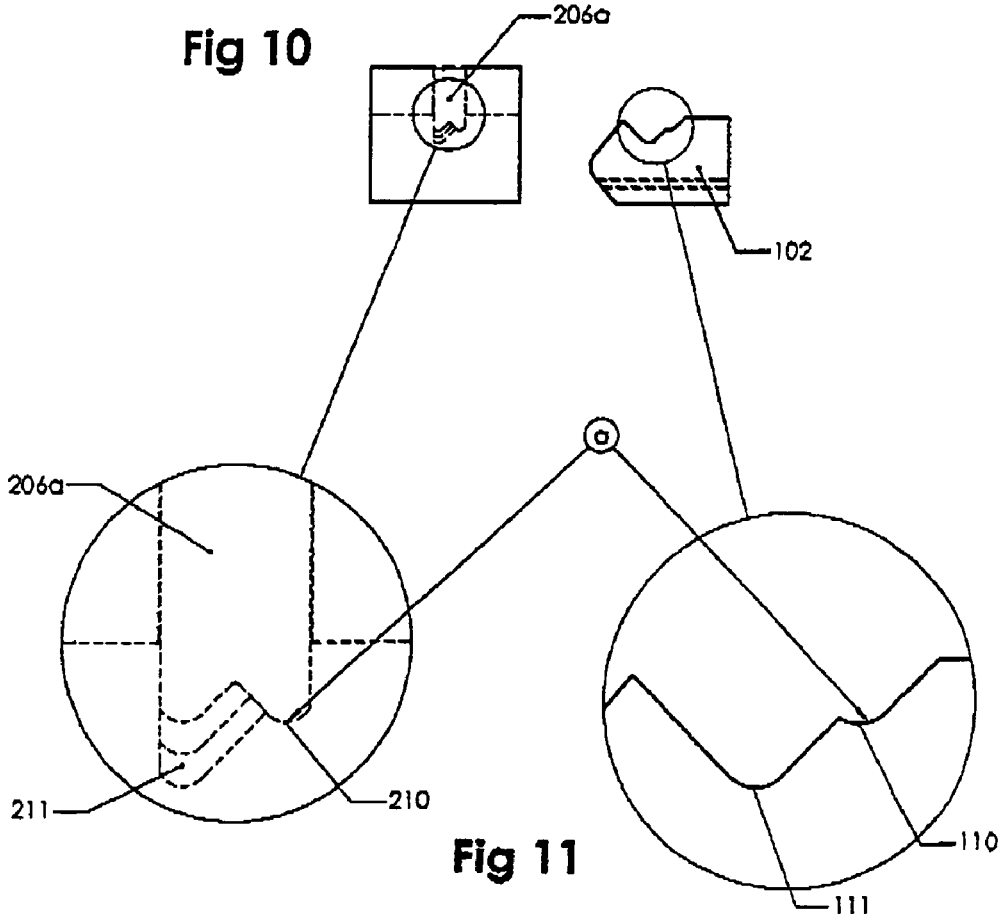
Fig 11

Fig 12
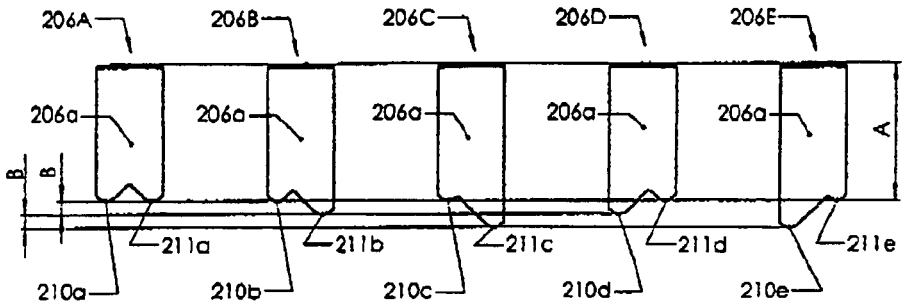
Fig 13a
Fig 13b
Fig 13c
Fig 13d
Fig 13e
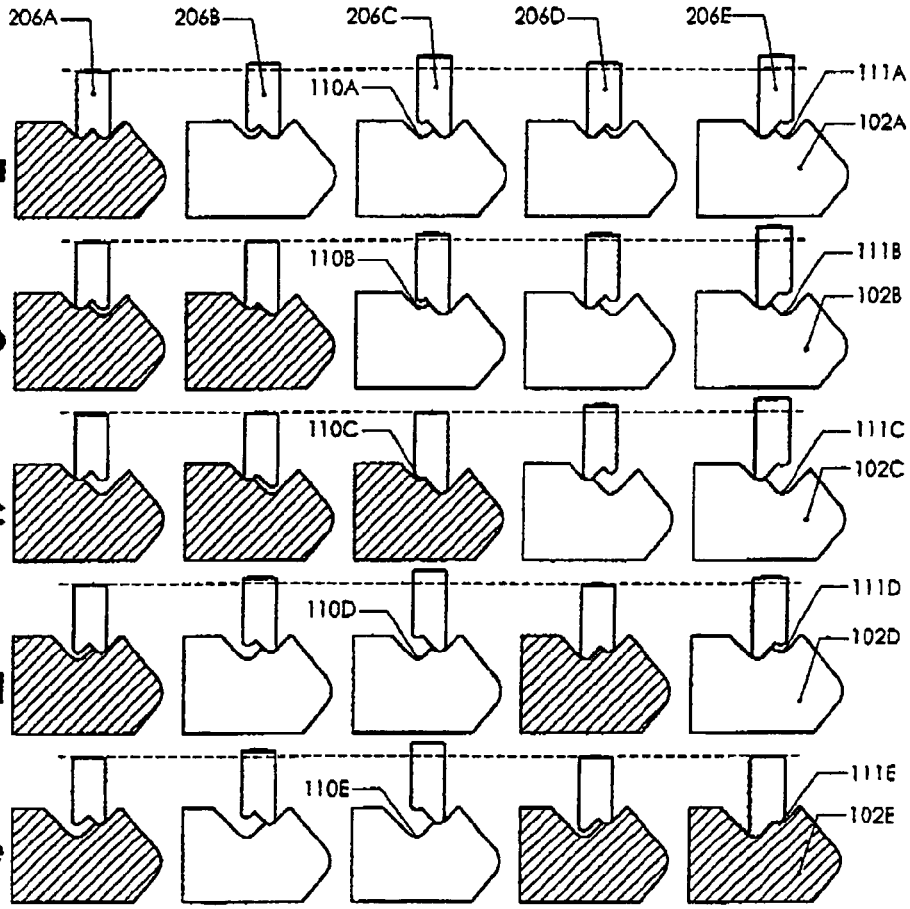

LOCK AND KEY SYSTEM WITH IMPROVED TUMBLERS IN THE LOCK

FIELD OF THE INVENTION

The present invention relates to a lock and key system with improved tumblers in the lock which provide a number of advantages, such as a large number of code combinations, possibilities of designing master key systems where the master keys look very much like any specific key operating only a single lock, and an overall increase of the security level, including protection against unauthorized key making.

Systems of a similar kind are generally known, e.g., from the U.S. Pat. Nos. 4,756,177; 5,067,335; 5,640,865; and 5,715,717 (all in the name of Bo Widén), the U.S. Pat. No. 4,635,455 (Medeco) and the international patent application published under No. WO 95/16092 (Medeco).

The invention also relates to a lock as such, a key or key blank as such, and a locking tumbler as such.

More particularly, the invention concerns a lock and key system including locks of the kind comprising:

a housing having a cylindrical bore, a cylindrical key plug being rotatably journalled in said cylindrical bore, said key plug having a longitudinal key slot and a number of locking tumblers in a row along a key plug axis for locking the key plug against rotation in the cylindrical bore, at least a subset of said locking tumblers comprising a body part and an integral key sensing part for engagement with an associated key, said body part being mounted in an associated chamber in said key plug for elevational movement therein along a tumbler axis in parallel with an axis of said associated chamber, and keys of the kind comprising:

a longitudinally extending key blade, which is insertable into said key slot of the key plug of an associated lock, said key blade having at least one longitudinal code pattern, including a number of code portions of varying depths for engaging with said integral key sensing part of said locking tumblers and making the key sensing part follow said longitudinal code pattern, when the key blade of said associated key is being inserted into the key slot.

As disclosed in the specifications referred to above, the longitudinal code pattern along the key blade may be located on an edge of the (generally flat) key blade, on a shelf or on a side surface of the key blade. The associated tumblers of the lock are arranged either centrally in relation to the key slot, so as to engage with a code pattern formed on the edge of the key, as disclosed in the Medeco patents, or sideways in relation to the key slot so as to engage with a code pattern formed on a shelf or at a side portion of the key blade, as disclosed in the Widén patents mentioned above. Of course, it is also possible to have two or more rows of locking tumblers, each row cooperating with an associated longitudinal code pattern of the corresponding key.

BACKGROUND OF THE INVENTION

The previously known systems referred to above provide a high level of security and permit a very high number of code combinations. Nevertheless, the methods being used for picking locks and for detecting master key codes, aiming at the unauthorized production of a master key, are steadily being developed and refined. Accordingly, there is a constant need for further improvement of the security level of lock and key systems, in particular to protect the coding being used in a particular lock and key system and to increase the security against unauthorised code detection and key making on the basis of one or more keys and associated locks.

OBJECT OF THE INVENTION

Against this background, a primary object of the present invention is to further increase the security level of lock and key systems of the kind specified above, particularly in respect of the cooperation of each locking tumbler and the associated longitudinal code pattern of the corresponding key.

Other, more specific but just as important objects are to further increase the number of possible code combinations, to make it even more difficult to pick any lock in the system and to eliminate the possibility for unauthorised persons to determine how the locking tumblers of a lock are to be positioned for operating the lock merely by analyzing the longitudinal code pattern of the associated key.

SUMMARY OF THE INVENTION

These objects are achieved for a lock and key system where the integral key sensing part of each locking tumbler in at least a subset of the row of tumblers comprises at least two neighbouring key contacting portions, confined within a limited region at a mutual distance not exceeding ¾ of the distance between the central axes of two adjacent locking tumblers in said row. Each such key contacting portion is provided with smooth edges, e.g. rounded or bevelled, for possible sliding engagement with the longitudinal code pattern of an associated key, when the latter is being inserted into the key slot of the lock. The number of code portions in the longitudinal code pattern of the associated key corresponds to the number of key contacting portions of the locking tumblers in said row, so the number of code portions is much larger than the number of tumblers in the row. At least one but not necessarily all of the key contacting portions of each locking tumbler in said subset will actually engage with a corresponding code portion of said associated key upon fully inserting the latter into the key slot.

So, generally, there will be a number of key contacting portions which do not actually make contact with a corresponding code portion, although it is theoretically possible that all of the contacting portions do make such a contact for a certain key.

A basic feature of the invention is the arrangement of two or more neighbouring key contacting portions on a locking tumbler, with an accompanying increase of the number of possible code combinations.

It should be acknowledged that the prior art includes a disclosure, a French patent application published under 2378159 (Neiman), of a lock having a row of tumbler plates disposed in transverse planes and each having spaced apart key contacting portions (not shown but suggested in the description on page 4, lines 21-23). However the distance between these key contacting portions is greater than the longitudinal distance between any pair of such tumbler plates, and these key contacting portions do not cooperate with corresponding code portions of the key blade so as to constitute a code pattern or coding system. In contrast, with the present invention, the contacting portions are located fairly close to each other as reflected by the wording "neighbouring" and the mutual distance being selected to be less than ¾ of the distance between the central axes of two adjacent locking tumblers in the row. Normally, these contacting portions are confined within the boundaries or cross-sectional area of the body portion of the locking tumbler, i.e. so as to be accommodated inside the associated chamber in which the locking tumbler is guided for movement upwards and downwards or back and forth.

Another preferred feature of the present invention is the redundancy resulting from the fact that one or more key contacting portions on the tumblers, at least in a subset of the tumblers in the row, are not used for actual contact with the specific code portions of a key operating a particular lock. When analyzing the longitudinal code pattern of such a key, it is not possible to determine which code portions will actually make contact with a corresponding key contacting portion of the associated locking tumbler.

In master key systems, all keys will have a large number of code portions, so it is generally not possible to tell whether a specific key operates one lock only, a number of locks in the system or all of the locks.

Preferably, a lock and key system according to the invention comprises at least a first lock and a second lock, which are different from each other, and at least a first key and a second key which are likewise different from each other, wherein the first key operates less than the total number of locks and the second key operates more locks than the first key, and wherein both keys have a number of code portions which will not make contact with the corresponding key contacting portions of the associated locking tumbler of the lock, upon full insertion of the respective key so as to operate the respective lock or locks.

Further preferred features of the lock and key system, the locks, the keys (or key blanks) and the locking tumblers according to the invention are defined in the claims and will appear from the detailed description below.

BRIEF DESCRIPTION OF THE DRAWINGS

The invention will be explained more fully below with reference to the appended drawings which illustrate some preferred embodiments of the invention.

FIG. 9 shows, in a perspective, schematic view, the end portion of a key blade and corresponding portions of three key plugs having a locking tumbler modified in three different ways so as to fit into the code portion of the key blade;

FIG. 10 is a side view of the key blade and the key plug of FIG. 9;

FIG. 11 shows, in partial views at a larger scale, the code portions of the key blade and the three modified tumblers of FIGS. 9 and 10;

FIG. 12 shows, in respective side views, five different locking tumblers;

FIGS. 13*a* through 13*e* show, in respective side views, five different key blades (end portions) cooperating with the five different locking tumblers of FIG. 12;

DETAILED DESCRIPTION OF SOME PREFERRED EMBODIMENTS

Figure 1:
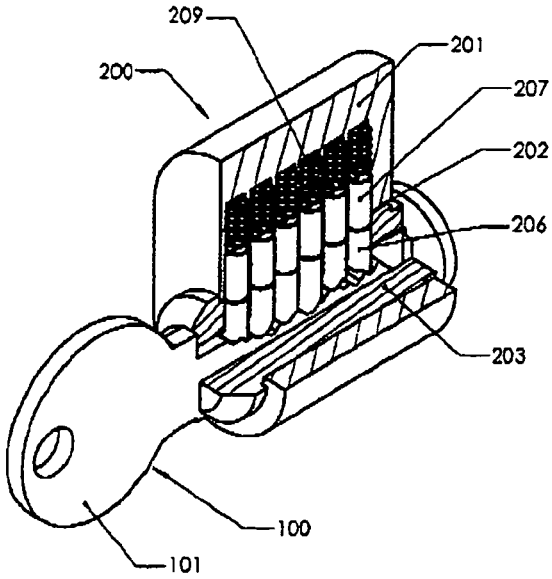
FIG. 1 shows, in a perspective schematic view, a key inserted into a lock in a system according to the invention, with parts of the lock being cut away for increased clarity.

In FIG. 1, there is schematically shown a cylinder lock 200 with a key 100 inserted therein. The key 100 comprises a grip portion 101 and a generally flat key blade 102, as shown more clearly in FIGS. 2 and 3. At the top edge portion of the key blade 102, there is a longitudinal, preferably wave-like code pattern 103, which includes a large number of concavities or cuts 104 which make contact with locking tumblers or locking pins of the lock when the key blade is being inserted into or pulled out of the lock.

Figure 3:
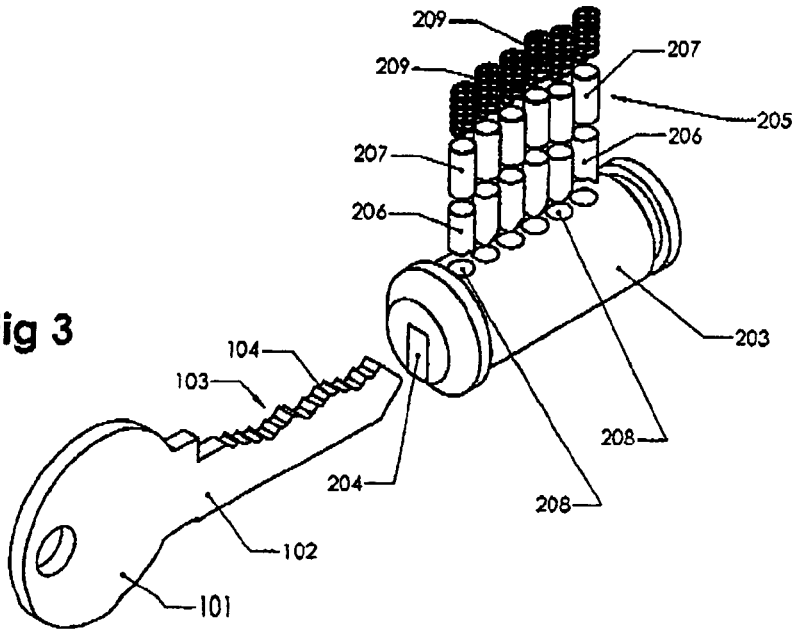
FIG. 3 shows the key and key plug of FIGS. 1 and 2 in a perspective view, with the locking tumblers taken out and shown separately above the key plug.

The cylinder lock 200 may be of the kind generally known from the patent specifications referred to above and comprises a housing 201 to be firmly mounted in an object to be locked, such as a door, the housing 201 having a cylindrical bore 202 in which a cylindrical key plug 203 is rotatably journalled. The key plug 203 has a longitudinal key slot 204 for receiving the key blade 102 of an associated key 100 and a number of locking tumblers, generally denoted 205 (FIG. 3). Normally, these locking tumblers 205 will lock the key plug 203 against rotation in the cylindrical bore 202 unless an associated, correctly coded key 100 has been fully inserted into the key slot 204.

In the illustrated embodiment, the locking tumblers 205 are arranged in a linear row along the key slot 204 and include lower pins 206 and upper pins 207 as is well known in the technology of cylinder locks. The lower pins 206 have cylindrical body portions 206*a* (FIG. 2) mounted in associated cylindrical chambers 208 (FIG. 3) and a lower key sensing part 206*b* making contact with the wave-like code pattern 103 of the key blade 102. A corresponding row of upper tumbler pins 207 are mounted in cylindrical chambers in the housing 201 and are biased downwardly by helical springs 209. Only when a correctly coded key blade 102 is fully inserted into the lock 200 will the mutually contacting end surfaces of the upper and lower pins 207, 206 be located flush with the inside surface of the cylindrical bore 202 of the housing 201 so as to enable rotation of the key plug 203 and opening of the lock.

Of course, the structure described so far is well known, e.g. from the patents referred to above.

According to the present invention, the key sensing part 206*b* of each locking tumbler or lower locking pin 206, or at least a subset of these tumblers, are provided with at least two neighbouring key contacting portions 210, 211, as will be described in detail below. See also FIG. 12 illustrating such locking tumbler pins with two neighbouring key contacting portions.

Figure 2:
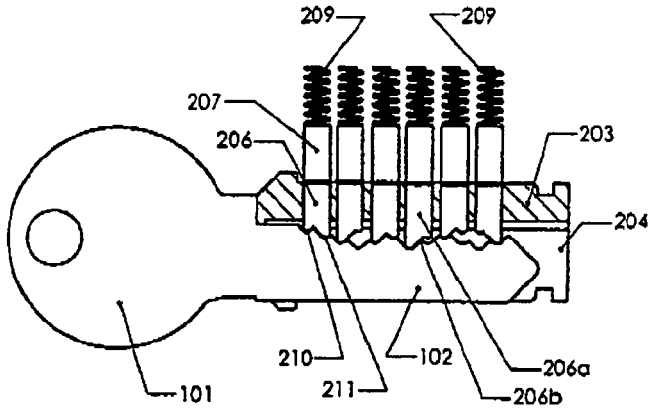
FIG. 2 shows the key plug of the lock and the key of FIG. 1 in a side view, partly in section.

As appears clearly from FIG. 2, the associated key blade includes a number of code portions or concavities in the preferably wave-like code pattern 103 of the associated key 100 corresponding to the number of key contacting portions of the locking tumblers in said row. In the embodiment shown in FIGS. 1-3, the number of such code portions or concavities 104 is twelve, i.e. equal to the number of key contacting portions 210, 211 of the lower ends of the six locking tumbler pins 206.

As illustrated in FIGS. 4*a* through 4*h*, the longitudinal code pattern of the key blade may take many different forms. These figures show only that part of the code pattern which corresponds to the innermost locking tumbler pin 206 located farthest away from the opening of the key slot 204. Also, the code pattern will depend very much on the corresponding configuration of the key sensing part of the tumbler.

Figure 4A:
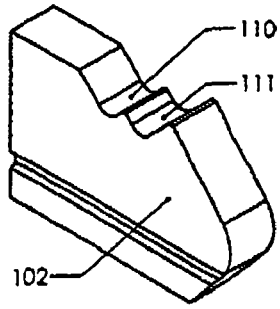
FIGS. 4*a* through 4*h* show the end portion of a key blade having a coded portion, in a perspective view of a number of different embodiments, in accordance with the present invention.

In FIG. 4*a*, there are two neighbouring concavities 110, 111 (see also FIG. 13*a*) having the same depth and being designed to engage with at least one of the two neighbouring key contacting portions of a locking tumbler pin of the kind illustrated in FIG. 12, these locking tumbler pins all having two neighbouring key contacting portions in the form of downwardly projecting lugs 210*a*, 211*a* (or 210*b*, 211*b* or 210*c*, 211*c* or 210*d*, 211*d* or 210*e*, 211*e*). These lugs are mutually displaced in the longitudinal direction of the key plug 203 and the key slot 204 but are confined within a limited region, the mutual distance between neighbouring lugs being less than ¾, preferably about one half (or possibly less than half), of the distance between the central axes of two adjacent locking tumbler pins in the row.

Typically, the tumbler pins have a diameter of about 2.7 to 3.0 mm, wherein the distance between the central axes of adjacent tumbler pins is about 3.7 to 4.0 mm, and the mutual distance between neighbouring lugs is about 2.0 mm or less, i.e. about half (or less than half) of the distance between the central axes of any two adjacent tumbler pins.

Figure 4E:
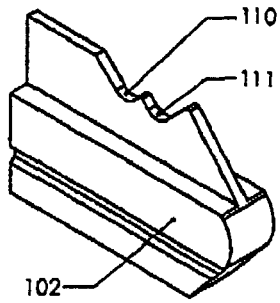
Figure 4F:
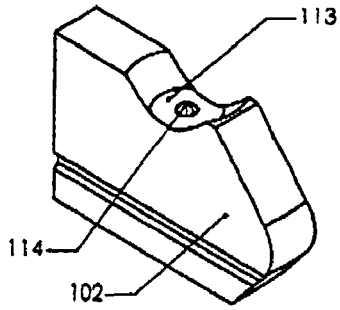
Figure 4B:
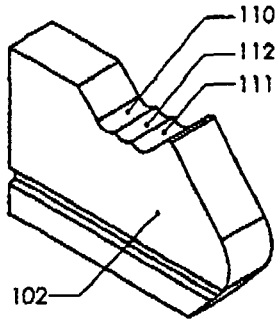
Figure 7A:
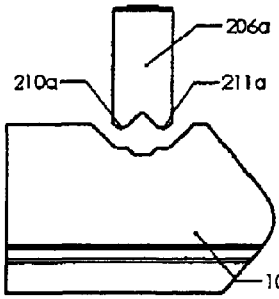
FIGS. 7*a* through 7*c* show, in a respective side view, the end portion of a key blade and an associated locking tumbler with two key contacting portions according to the present invention.
Figure 7B:
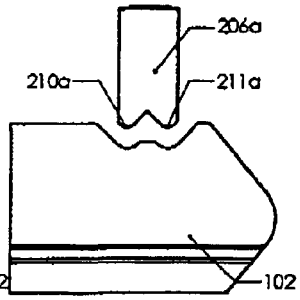
Figure 7C:
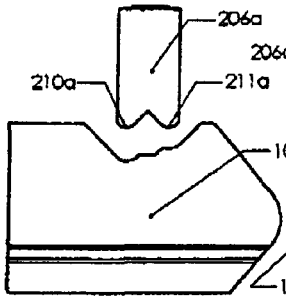
Figure 7D:
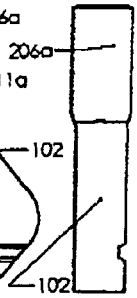
FIG. 7*d* shows an end view of the key blade and the associated locking tumbler of FIGS. 7*a* through 7*c;*

In FIG. 4*b*, there are three neighbouring concavities, namely two spaced apart concavities 110 and 111, corresponding to those shown in FIG. 4*a*, and a central concavity 112. The central concavity 112 may cooperate with a third, central lug (not shown of a tumbler pin or with a tumbler pin of the kind shown in FIGS. 5*a*, 5*b*, 5*c* and 5*d*. The latter kind of pins 206' include a single, downwardly projecting key contacting portion 213 which is substantially conical with a rounded lower end. Such a key sensing part 213 may be regarded as including a first peripheral or annular key contacting portion and a second, central key contacting portion radially inside the first one. In case the key sensing part 213 is regarded as a single key contacting portion, it would be possible to mix, within the same lock, tumbler pins 206 of the kind shown in FIG. 12 and tumbler pins 206' of the kind shown in FIGS. 5*a* through 5*d*. The code pattern shown in FIG. 4*c* includes two spaced apart code portions 110, 111 and a central, deeper code portion 112' therebetween. Such a pattern corresponds to those shown in FIG. 5*b* and FIG. 7*a* and may cooperate with tumbler pins of the kind shown in FIG. 5*b* (206') or FIGS. 7*a* through 7*d* or FIG. 12 (tumbler pin 206A) or even the one shown in FIG. 8*a* (tumbler pin 206"). The latter tumbler pin 206" has a lower key sensing part in the form of an annular peripheral surface 214 and a central recess 215 (FIG. 8*b*).

Figure 4G:
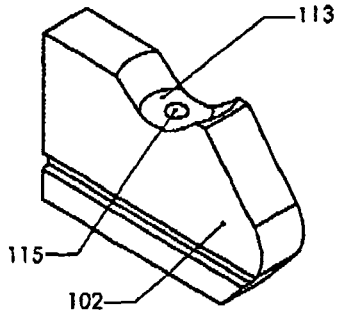
Figure 4C:
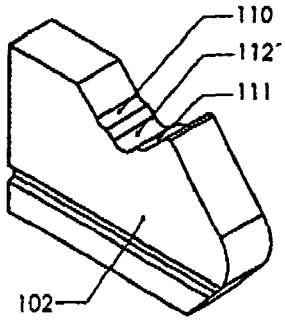
Figure 4H:
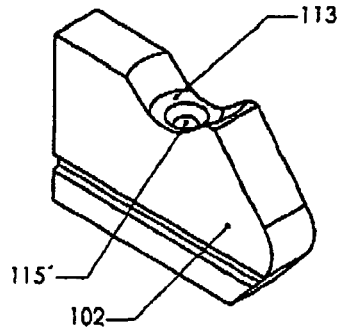
Figure 4D:
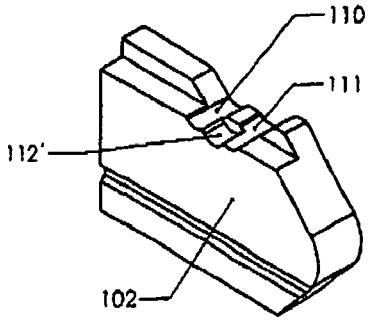

In FIG. 4*d* (see also FIG. 30), the code pattern is divided into two parallel code patterns formed side by side at the upper edge of the key blade. Thus, on one half of the key blade there is a code pattern corresponding to the one shown in FIG. 4*a* with two concavities 110 and 111, and on the other half of the key blade, the code pattern corresponds to the one shown in FIG. 4*c* with a deep central concavity 112' between the code portions 110, 111. Such a code pattern, or rather pair of parallel code patterns, may cooperate with pin tumblers of the kind shown in FIGS. 6*a* and 6*b*, these tumbler pins 206''' having a different configuration on the left and right half portions thereof, as appears from FIG. 6*b*. For such tumbler pins 206''' it is important that they do not rotate, and they are therefore provided with guiding fins 216' which are guided in corresponding grooves along the cylindrical chambers in the key plug so as to securely maintain their rotational position.

Figure 30:
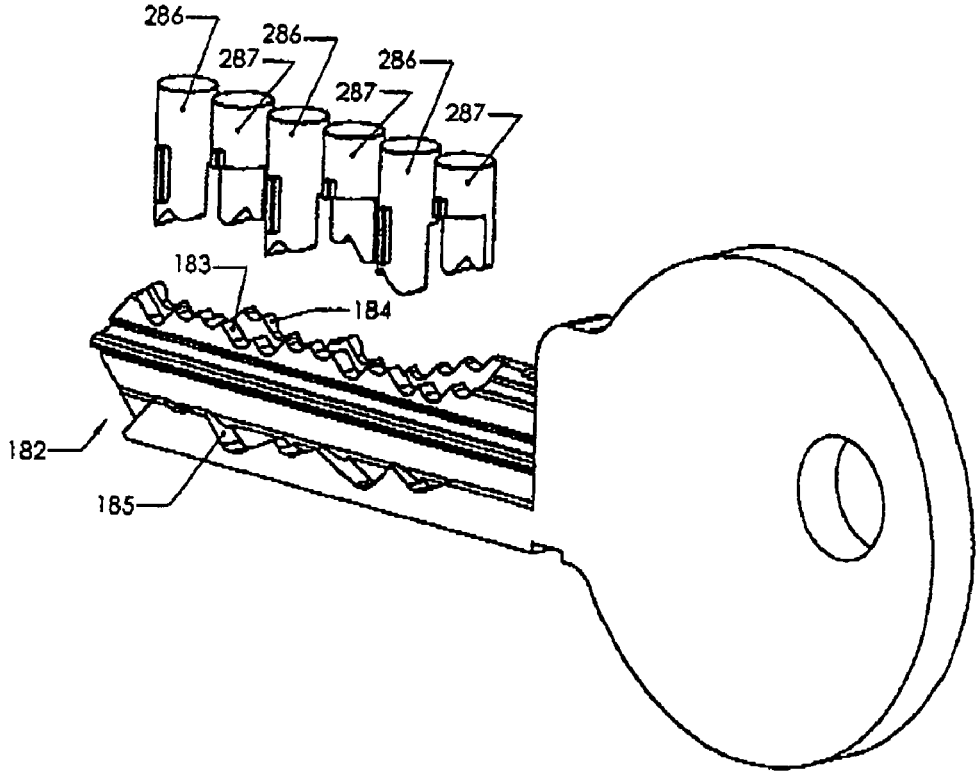
FIG. 30 shows, in a perspective view, a further embodiment of a key according to the invention and associated top pins for engagement with an upper edge code pattern of the key.

An entire key with a pair of parallel code patterns at the upper edge position of the key is also illustrated in FIG. 30.

The code pattern shown in FIG. 4*e* is similar to the one shown in FIG. 4*a*, but the upper edge portion of the key blade is much thinner. This code pattern may cooperate either with the kind of tumbler pins shown in FIG. 12 having longitudinally displaced lugs 210*a*, 211*a* etc. or a tumbler pin 206" of the kind shown in FIG. 8*a*, 8*b* being rotationally symmetrical with a central recess 215.

Figure 8A:
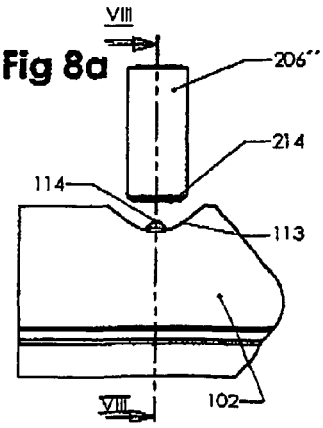
FIGS. 8*a* and 8*b* show, in side and cross-sectional views, the end portion of the key blade of FIG. 4*f* and an associated locking tumbler.
Figure 8B:
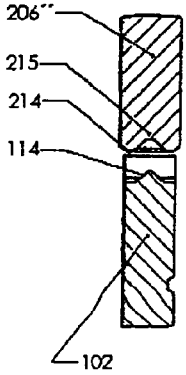

The code pattern shown in FIG. 4*f* corresponds to the one shown in FIGS. 8*a* and 8*b*, including an annular portion 113, cooperating with the annular key contacting portion 214 of the tumbler pin 206", and a central projection 114, fitting into the recess 215 of the tumbler pin 206". The projection 114 does not necessarily make contact with the bottom of the recess 215. Moreover, the projection 114 may alternatively serve as a support for a tumbler pin 206' of the kind shown in FIGS. 5*a* through 5*d* or a tumbler pin (not shown) having an entirely flat bottom surface.

In FIG. 4*g*, the code pattern includes an annular surface 113 and central recess 115. Such a code pattern may cooperate with either one of the tumbler pins 206' (FIG. 5*a* through 5*d*), 206*a* (FIGS. 7*a* through 7*d*) or 206" (FIG. 8*a*, 8*b*). FIG. 4*h* shows a similar code pattern as in FIG. 4*g*, the only difference being that the central recess 115' is deeper.

The code pattern according to FIGS. 4*e*, 4*f*, 4*g*, 4*h* may also cooperate with a central lug (not shown), as indicated above with reference to FIG. 4*b*. Such a central lug may be fixed or possibly movable as the inner part of a so called "telescopic pin", as is generally known in lock cylinders marketed under the trade name MULTILOCK.

A code pattern as per FIGS. 4*f*, 4*g*, 4*h* may be disposed laterally to either side (not shown) of the top edge of the key blade in such a way that the vertical center line of the tumbler pin falls within the thickness of the key blade or falls within the side surfaces of the key blade or even falls slightly outside of the key blade. Such a modified code pattern (as shown in FIGS. 4*f*, 4*g* and 4*h*) may also be made on a side shelf of a key e.g. as disclosed in U.S. Pat. Nos. 4,454,432 and 5,640,865 (both in the name of Bo Widén), or it may be used together with key profiles as per FIGS. 7*e* and 7*f*.

In a normal locking key system, it would be feasible to use code patterns of a similar kind, such as the one shown in FIG. 4*a* with different depths of the concavities 110, 111 (see FIGS. 12 and 13*a* through 13*e*). Other similar code patterns are those shown in FIGS. 4*e*, 7*e* and 7*f* (with a thin upper edge portion of the key blade), the ones shown in FIGS. 4*b* and 4*c* (three longitudinally spaced code portions for each tumbler pin), 4*d* (with longitudinally parallel code patterns on the left and right hand sides of the key blade), and the patterns shown in FIGS. 4*f*, 4*g* and 4*h* (cooperating with tumbler pins 206' and 206" as shown in FIG. 5*a*-5*d* and FIG. 8*a*, FIG. 8*b*).

Figure 5A:
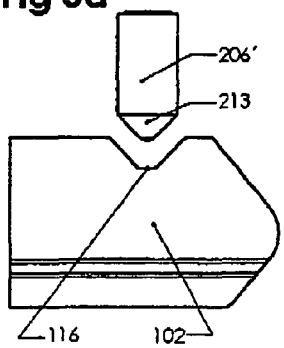
FIGS. 5*a* through 5*c* show, in a respective side view, the end portion of a key blade (with three different code portions) and an associated locking tumbler.
Figure 5B:
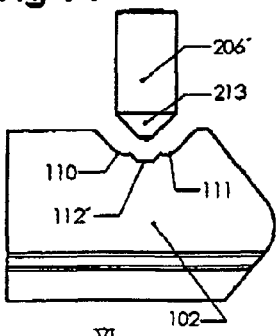
Figure 5C:
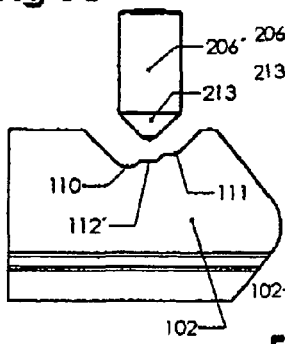
Figure 5D:
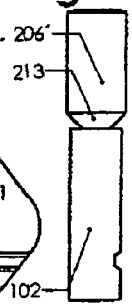
FIG. 5*d* shows an end view of the key blade and the associated locking tumbler of FIGS. 5*a* through 5*c;*

FIGS. 5*a*, 5*b* and 5*c* illustrate that one kind of tumbler pin 206' cooperates well with different code patterns, e.g. a single V-cut with a flat bottom 116, as shown in FIG. 5*a*, a code pattern with three code portions 110, 111, 112', as shown in FIG. 5*b* (and also in FIG. 4*c*) or a different pattern with three code portions 110, 111, 112', as shown in FIG. 5*c*.

Figure 7E:
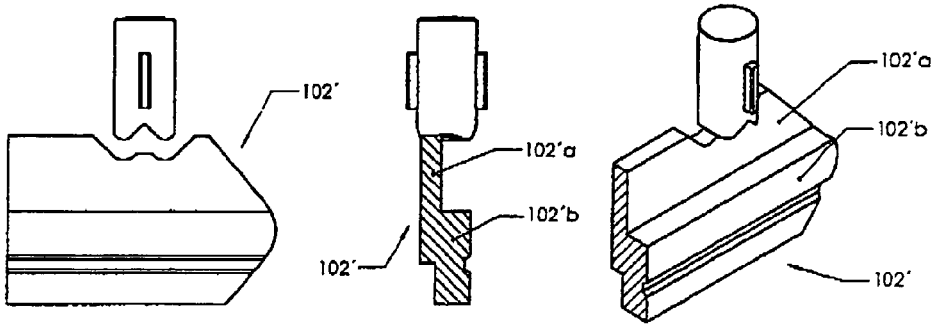
FIGS. 7*e* and 7*f* show, in side views, cross-sectional views and perspective views, two modified embodiments where the upper edge portion of the key blade is thinner and displaced in relation to a base portion of the key blade.
Figure 7F:
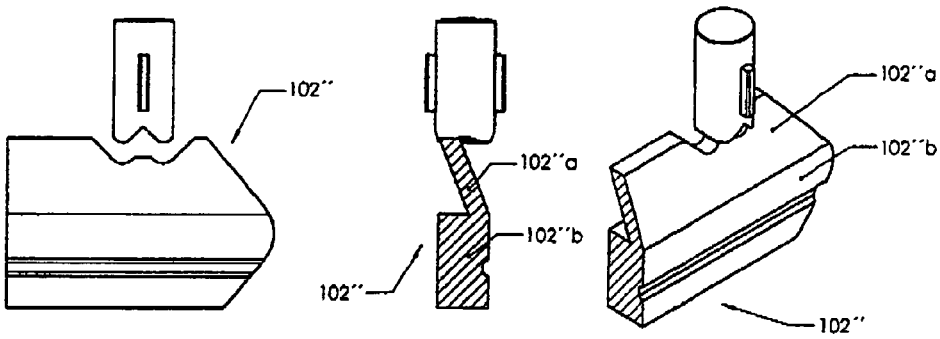

A code pattern as shown in FIGS. 7*e*, 7*f* on an "offset" key blade (or key blank) does not function together with tumbler pins 206' because the key does not support the pin tip (and not even the conical part of the pin tip). To cooperate with code portions as per FIGS. 7*e*, 7*f*, the tumblers must have a width which is sufficient to make contact with the "offset" coded key portions. Such key profiles and key blanks are unique for this lock design.

Similarly, as shown in FIGS. 7*a* through 7*d* and also in FIG. 12, a tumbler pin 206A with two lugs 210*a*, 211*a*, 210*b*, 211*b*, 210*c*, 211*c*, 210*d*, 211*d*, 211*e* spaced in the longitudinal direction, will cooperate with different code patterns having two or three code portions.

Now, the possibilities of varying the neighbouring key contacting portions of a tumbler pin having a cylindrical body portion 206*a* will be described with reference to FIGS. 9, 10, 11, 12 and 13*a* through 13*e*. Herein, "cylindrical" does not necessarily mean "circular-cylindrical" but may include other cross-sectional configurations than circular, as long as the body portion is effectively guided for reciprocal movement upwards and downwards or back and forth.

In FIG. 9, there is shown the end part of a key blade 102 having a code pattern at its upper edge with two concavities 110, 111 and the corresponding parts of three associated key plugs 203 with three different tumbler pins 206*a* (having different lower ends). In FIG. 10, the end portion of the key blade 102 and the tumbler pin 206*a* are shown in a side view, and FIG. 11 shows the particular code pattern with the concavities 110, 111 and the key contacting portions 210, 211 of the tumbler pin, at a larger scale. It will be clearly apparent from FIG. 11 that in case the key contacting portion or lug 210 contacts the corresponding code portion or concavity 110, the body portion 206*a* of the tumbler pin will be positioned at the same vertical level irrespective of the depth of the other key contacting portion or lug 211, this being due to the fact that the code portion or concavity 111 is very deep.

The tumbler pins shown in FIG. 12 all have the same kind of cylindrical body portion 206*a* but different key sensing parts. Thus, the tumbler pin 206A has two lugs 210*a*, 211*a* of equal depth, both being relatively short, as seen along the cylindrical axis of the tumbler pin. The next tumbler pin 206B has one short, rear lug 210*b* and one longer, forward lug 211*b*. The following tumbler pin 206C has a short rear lug 210*c* and an even longer, forward lug 211*c*. The next tumbler pin 206D has a long rear lug 210*d* and a short forward lug 211*d* and, finally, the tumbler pin 206E has a very long rear lug 210*e* and a short forward lug 211*e*.

The key blade 102A shown in FIG. 13*a* has two code portions or concavities of equal depths, 110A, 111A being rather shallow corresponding to the shorter lugs 210*a*, 211Aa, 210*b*, 210*c*, 211*d* and 211*e* of the tumbler pins. The key blade 102B has one shallow rear concavity 110B and one deeper, forward concavity 111B. The next key blade 102C has a shallow, rear concavity 110C and a very deep forward concavity 110C. The following key blade 102D has a deep, rear concavity 110D and a shallow forward concavity 111D. Finally, the key blade 102E has a very deep rear concavity 110E and a shallow forward concavity 111E.

The respective tumbler pin will permit rotation of the key plug and opening of the lock only if it is positioned with its upper end surface at the shear line flush with the inside surface of the cylindrical bore 202 (FIG. 1). These positions are indicated in FIGS. 13*a* (206A), 13*b* (206A, 206B), 13*c* (206A, 206B, 206C), 13*d* (206A, 206D) and 13*e* (206A, 206D, 206E) by hatched lines on the key blade.

The twenty-five combinations of various tumbler pins 206A through 206E and different key blades 102A through 102E illustrate how these combinations can be used in a master key system. Accordingly, by using only tumbler pins of the kinds 206A, 206B and 206C (for all six tumbler positions along the row with e.g. six tumblers as illustrated in FIGS. 1-3), certain keys, with the key blade 102A, will only operate and open one lock or group of locks (having tumbler pins of the kind 206A). A second key or group of keys, such as the key 102B (a so called "master key"), will operate two locks or groups of locks, having tumbler pins of the kinds 206A and 206B, whereas keys or groups of keys, such as the key blade 102C, will open all locks or groups of locks having tumblers of the kinds 206A, 206B, 206C. Of course, the latter key 102C will then serve as a master key which operates all locks in the system.

Another possibility is to use only tumbler pins of the kinds 206A, 206D and 206E.

All keys in such a lock and key system will look very much alike, with twelve concavities along the upper edge of the key blade, as illustrated in FIG. 3, and it will be virtually impossible for anybody having access to only one key, or a few keys and associated locks, to determine whether the key is a specific key operating only one lock or a master key operating several locks, or all locks in the system.

Of course, the possible number of combinations is very high indeed, since it is also possible to use different kinds of tumbler pins with neighbouring key contacting portions, as illustrated generally in FIGS. 5*a* through 5*d*, FIGS. 6*a*, 6*b*, FIGS. 7*a* through 7*f* and FIGS. 8*a*, 8*b*.

Figure 13F:
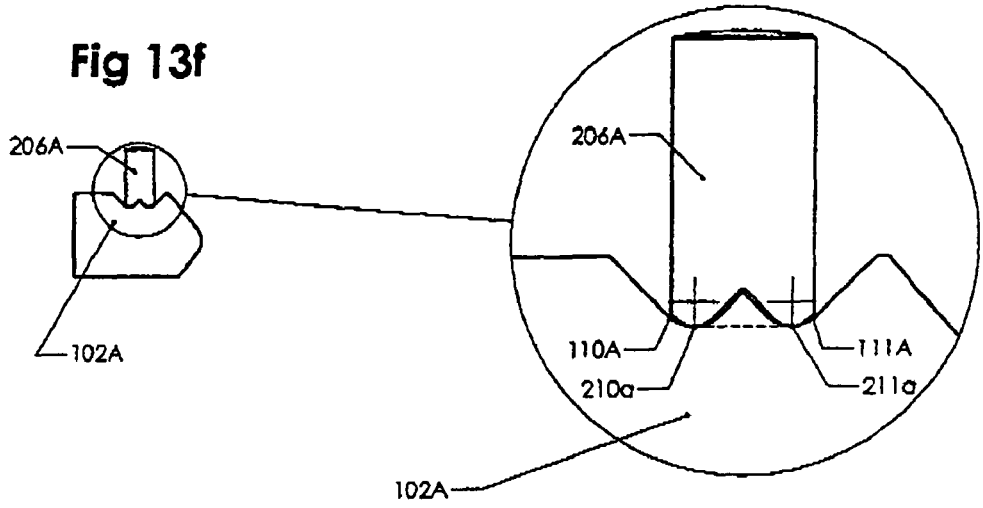
FIGS. 13*f* through 13*h* show, in similar side views, an end portion of a key blade and an associated locking tumbler in a modified embodiment.
Figure 13G:
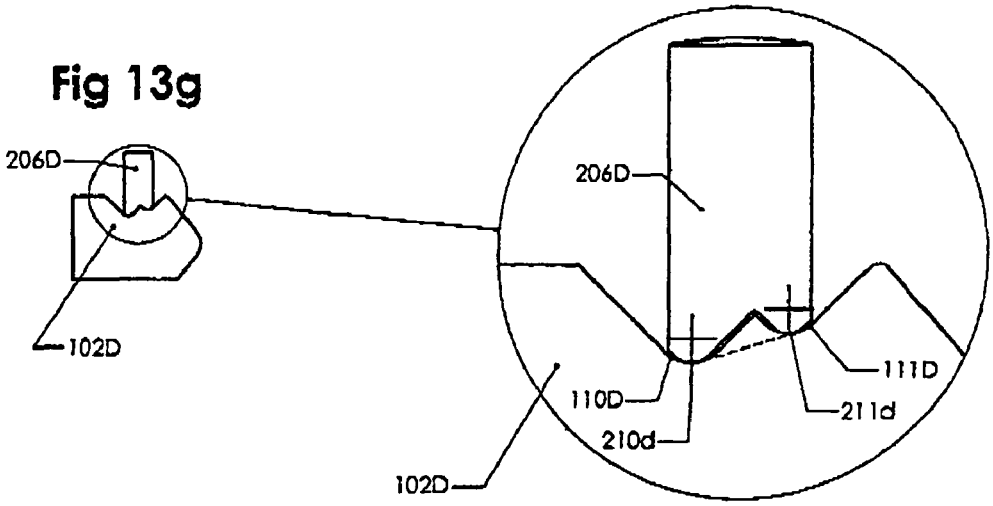
Figure 13H:
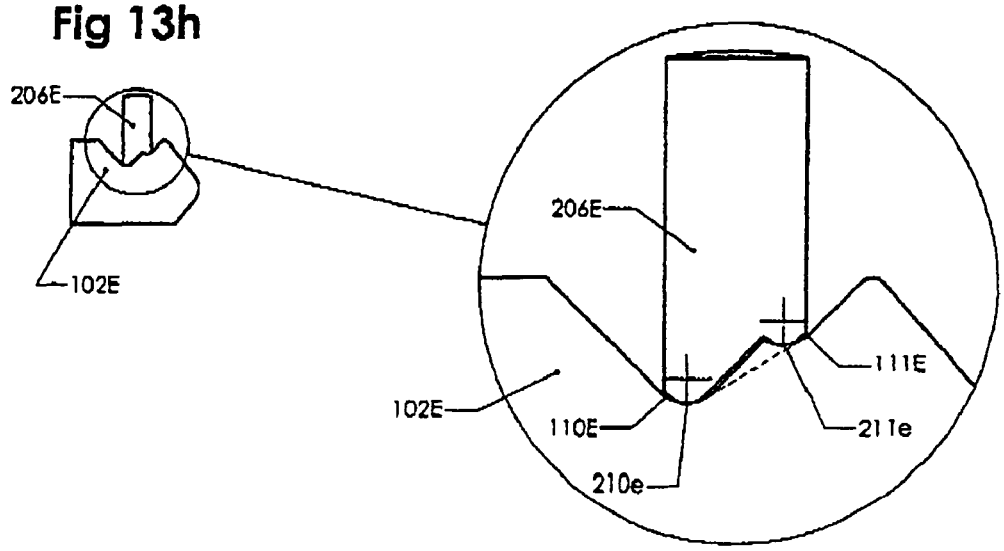

A possible modification of the code pattern is illustrated in FIGS. 13*f* through 13*h*. In FIG. 13*f*, the locking pin 206A has two short lugs 210*a* and 211*a*, in FIG. 13*g*, it has a long, rear lug 210*d* and a short, forward lug 211*d*, and in FIG. 13*h*, it has a very long, rear lug 210*e* and a short, forward lug 211*e*. From these figures it is apparent that the code pattern of the key blade 102A, 102D and 102E, respectively, can be modified somewhat and still support the associated locking pin 206A, 206D, 206E so as to hold in the same position, viz. by cutting away some of the material between the two tumbler contacting portions 110A, 111A; 110D, 111D; and 110E, 111E; respectively, e.g. along the dotted line in each figure. Such modified keys or key blanks are also covered by the protective scope of the appended claims. However, it should be noted that the modifications as per FIGS. 13*g* and 13*h* may not give a precise positioning of the tumbler pin in the contacting portions 111D and 111E, as would be preferred.

Thus, it would be preferable to maintain at least some portion of the concavities 110A, 111A, 111D and 111E so as to ensure that a tumbler lug (e.g. any of the lugs 211*a*, 11*b*, 211*c*, 211*d*) may be securely positioned in such a concavity (e.g. 111E).

Figure 15:
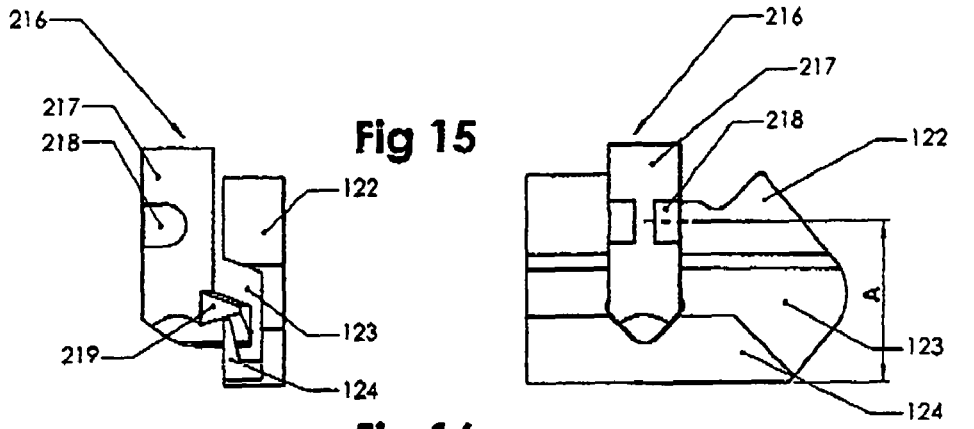
FIGS. 15, 16, 17 and 18 show, in schematic end views and side views, respectively, a locking tumbler having a transversely extending finger cooperating with a side code pattern of a key blade (as also illustrated in FIGS. 14*a* through 14*h*)

Furthermore, the key sensing part of the tumbler does not have to be located at the end portion of the cylindrical body portion, but may be disposed e.g. on a finger extending transversally from the body part, as illustrated in FIGS. 15 through 19. Such tumblers may be of the general kind disclosed in the above mentioned U.S. Pat. Nos. 4,756,177; 5,067,355; and 5,715,717 (in the name of Bo Widén). A side tumbler 216 of this kind is shown in FIG. 15. It is located in a cylindrical chamber (not shown) at the side of the key slot of the key plug so as to be movable (and possible also rotatable) upwards and downwards in parallel to the key slot while engaging a side code pattern on the key blade 122 with a finger 219 extending transversally from the lower end of the body portion 217 of the side tumbler 216. The body portion 217 of the side tumbler 216 is provided with recesses 218 fitting into a side bar (not shown) upon being moved into a predetermined position, permitting the side bar to open the lock as described in the US patents referred to above.

As an alternative (not shown), the side tumbler, with or without a transversal finger, may cooperate with a longitudinal code pattern formed on a shelf at the upper side of a solid base portion of the key blade, e.g. as disclosed in the above mentioned U.S. Pat. No. 5,640,865 (Widén).

Figure 14A:
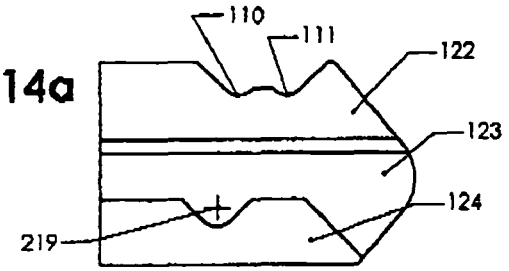
FIGS. 14*a* through 14*h* show, in respective side views, the portion of a key blade provided with two separate code patterns, one on the upper edge portion and the other on the side of the key blade, the side code pattern being modified in the various figures.

As is likewise described in the above-mentioned U.S. Pat. No. 5,715,717 (Widén) the key blade 122 has a longitudinal side groove 123 defined by side walls and a bottom wall, the lower side wall being inclined so as to form an undercut portion of the groove 123. The wave-like code pattern is formed in the side wall portion 124 defining the undercut portion of the side groove 123. See also FIG. 14*a* illustrating the key blade 122 only. The location of the finger 219 is schematically illustrated by the symbol "+". From FIGS. 14*a* through 14*h* it will be apparent that the key blade in this embodiment has two wave-like code patterns, one on the upper edge portion of the key blade, with concavities 110 and 111, and another one formed on the side wall portion 124 for engagement with the transverse finger 219 on the side tumbler 216.

Figure 16:
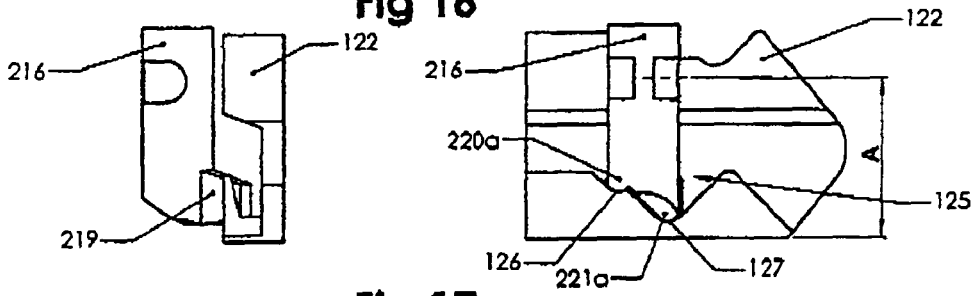
Figure 17:
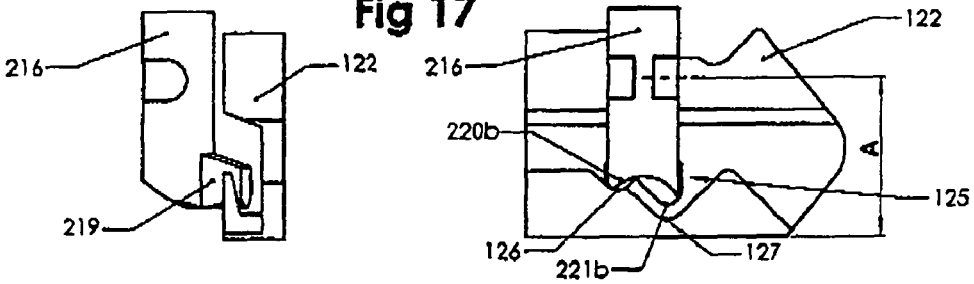
Figure 18:
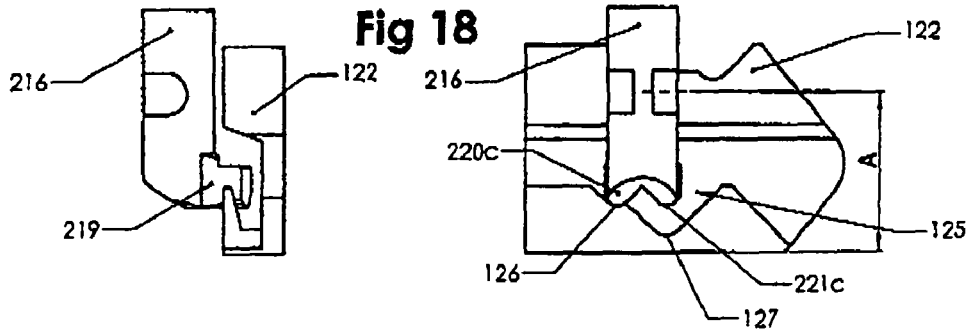
Figure 19:
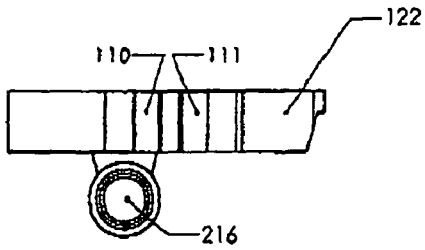
FIG. 19 shows the locking tumbler and the key blade of FIGS. 15 through 18, as seen from above.

In accordance with the present invention, as illustrated to the right in FIGS. 16, 17 and 18, the transverse finger 219 is provided with two or more key contacting portions, in this case distributed in the longitudinal direction of the key plug (not shown).

Like the key contacting portions in the embodiments described above, the key contacting portions are confined within a limited region, at a mutual distance being less than ¾ of the distance between the axes of two adjacent tumblers.

In FIG. 16, the lower part or underside of the finger 219 has a short rear lug 220*a* and a very long forward lug 221*a*, these two lugs fitting into corresponding code portions or concavities 126 and 127, respectively, of the wave-like code pattern 125.

In FIG. 17, the tumbler 216 has a transverse finger 219 with a short rear lug 220*b* and and a longer lug 221*b* (although not as long as the lug 221*a* in FIG. 16).

In FIG. 18, both the rear and forward lugs 220*c* and 221*c* are short.

Basically, the interrelation between the tumbler 216 and the code pattern 125 (from a coding standpoint) is the same as the one illustrated in FIGS. 13*a* through 13*e*.

As appears from the FIGS. 14*b* through 14*h*, it is possible to modify the wave-like side code pattern 125 independently of the upper code pattern 110, 111 which is the same in all these figures although, of course, that code pattern may be varied as well (or even omitted in case the lock is provided with side tumblers only). A modification as illustrated in FIGS. 13*f* through 13*h* would also be possible.

Figure 14B:
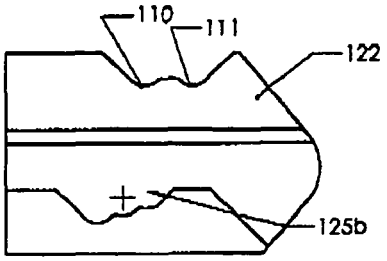
Figure 14G:
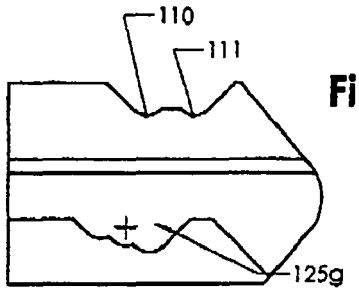
Figure 14C:
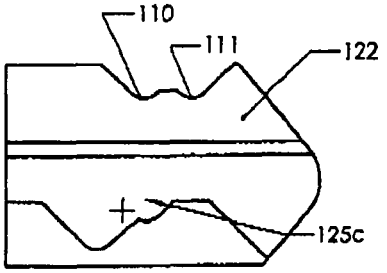
Figure 14H:
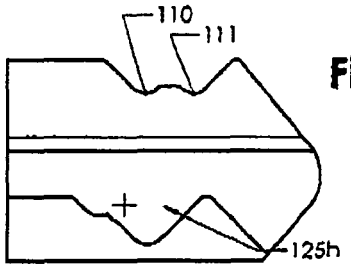
Figure 14D:
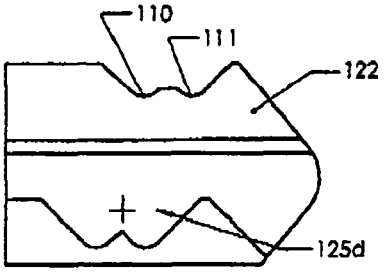
Figure 14E:
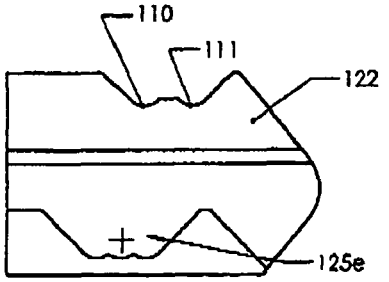
Figure 14F:
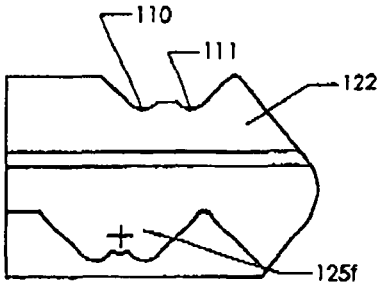

In FIG. 14*b*, the side code pattern includes three concavities at different levels, in FIG. 14*c*, there is one rear very deep concavity and a forward shallow concavity, in FIG. 14*d*, the pattern 125*d* includes two very deep concavities, in FIG. 14*e*, the code pattern 125*e* is similar with a very deep mid concavity as well, in FIG. 14*f*, the code pattern 125*f* includes rear and forward very deep concavities and a relatively deep concavity therebetween, in FIG. 14*g*, there is a shallow rear concavity, a middle deep concavity and a forward very deep concavity in the pattern 125*g* and, finally, in FIG. 14*h* the code pattern 125*h* is the same as in FIG. 18 with a rear shallow concavity and a forward very deep concavity.

Figure 20A:
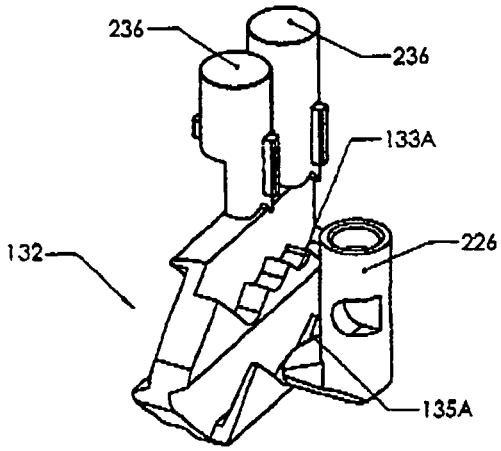
FIGS. 20*a*, 20*b* and 20*c* show, in perspective and sectional views, a further embodiment with a key blade, which can be turned upside down and which cooperates with a row of side tumblers and another row of upper tumblers, the tumblers being displaced from the key blade for clarity.
Figure 20B:
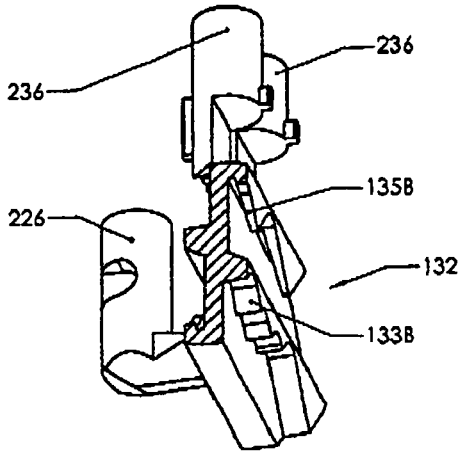
Figure 20C:
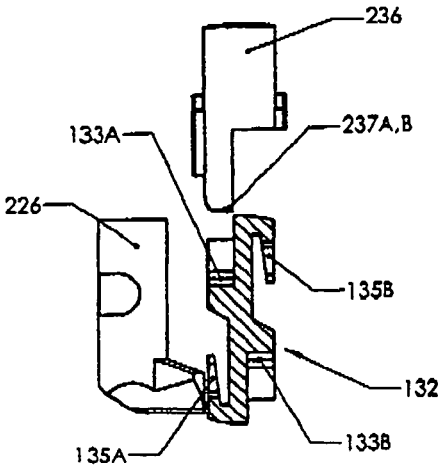
Figure 21:
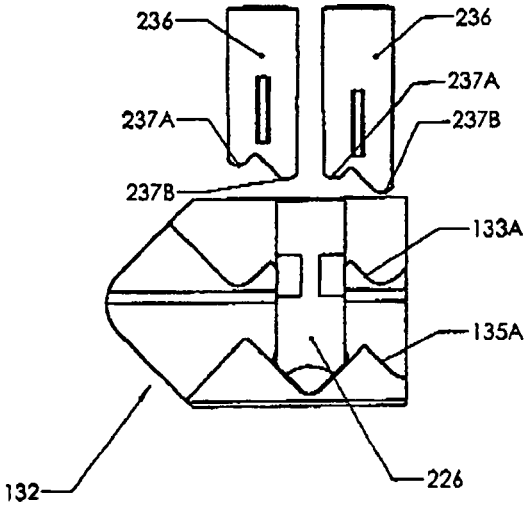
FIG. 21 shows, in a side view, the key blade and the two upper tumblers of FIGS. 20*a*, 20*b* and 20*c;*
Figure 22A:
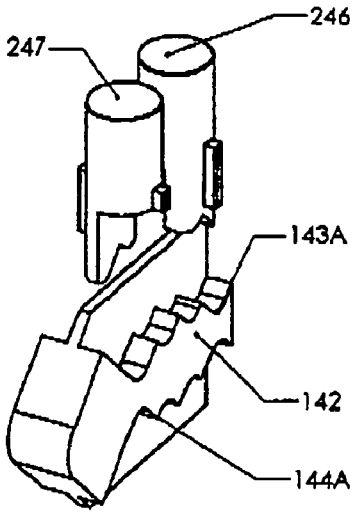
FIGS. 22*a*, 22*b* and 22*c* show, in perspective and sectional views, a further embodiment including a key blade, which can be turned upside down and which cooperates with an upper row of tumblers having alternating right and left key contacting portions.
Figure 22B:
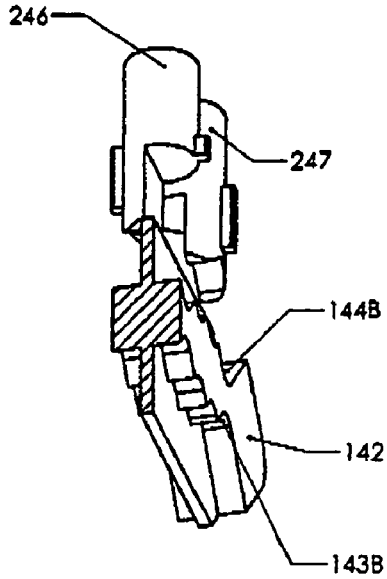
Figure 22C:
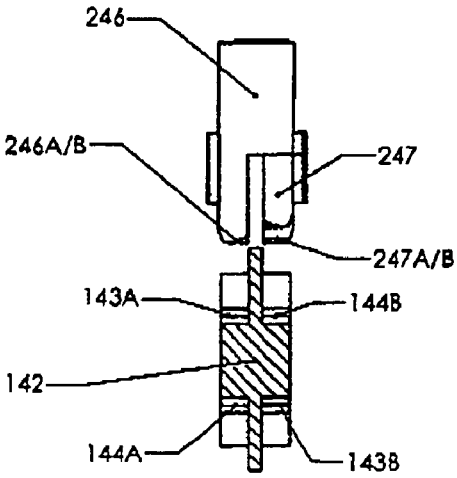

In FIGS. 20*a*, 20*b* and 20*c*, there is shown a key blade 132 having, on both sides thereof, a side code pattern 135A and 135B, respectively, and upper and lower shelf code patterns 133A, 133B cut out from upper and lower shelves of the key blade. These side and shelf code patterns are pair-wise identical to each other, so that the key blade can be turned upside down and still operate in the same way in cooperation with the respective locking tumblers. A first row of side tumblers 226, e.g. as shown in FIGS. 15 through 19 or of the general kind disclosed in any of the above mentioned US patents to Widén (or as disclosed in the patent applications WO 2003/062570 (Winloc), WO 2005/028789 (Winloc) and SE 0500624-2 (Winloc), cooperates with either one of the side code patterns 135A, 135B, whereas a row of upper locking tumblers 236 cooperates with either one of the shelf code patterns 133A, 133B. These upper locking tumblers 236 are provided with key contacting portions 237A, 237B, located on one longitudinal side of the key, the two key contacting portions 237A, 237B being spaced apart somewhat in the longitudinal direction, as appears from FIG. 21. However, as in the previous embodiments, the longitudinal distance should be less than ¾ of the distance between two neighbouring tumblers, in this case about half of this distance. Accordingly, the various key contacting portions 237A, 237B in the row of tumblers are uniformly distributed in the longitudinal direction (see FIG. 21).

Figure 23:
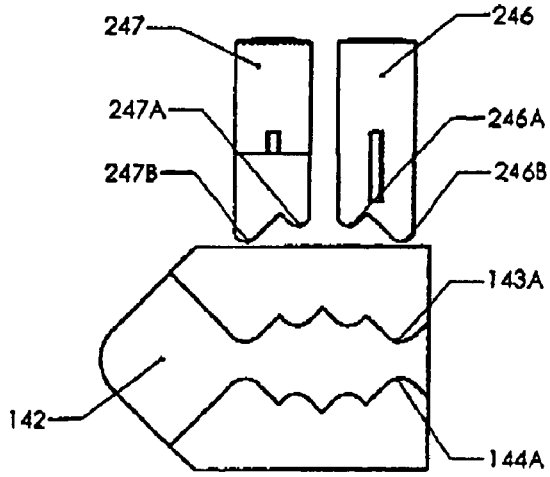
FIG. 23 shows, in a side view, the key blade and the two upper tumblers of FIGS. 22*a*, 22*b* and 22*c;*
Figure 24A:
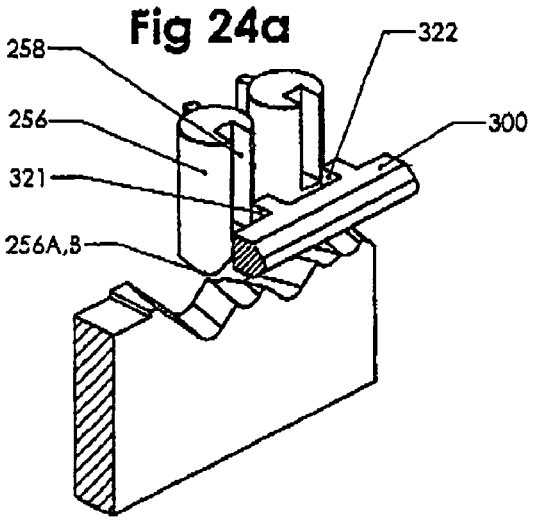
FIGS. 24*a*, 24*b* and 24*c* show, in perspective and side views, a portion of a key blade and tumbler pins being guided for limited rotational movement and cooperating with a side bar.
Figure 24B:
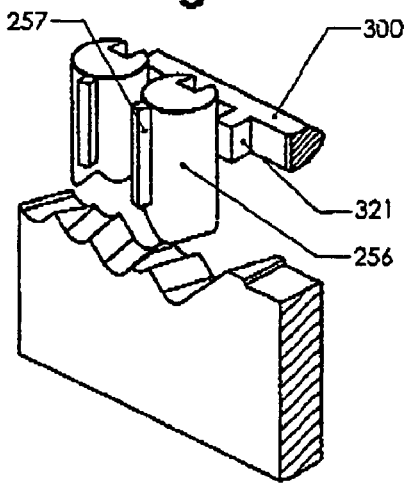
Figure 24C:
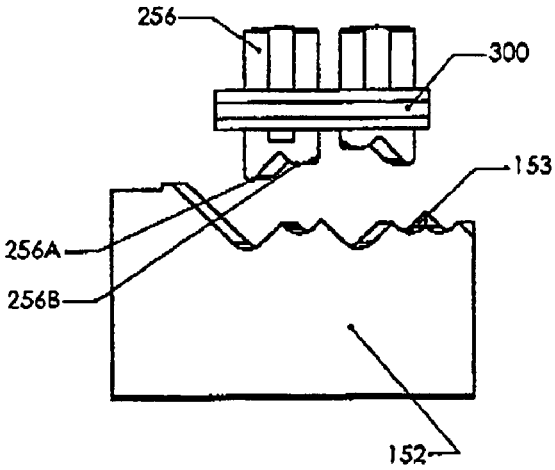
Figure 25:
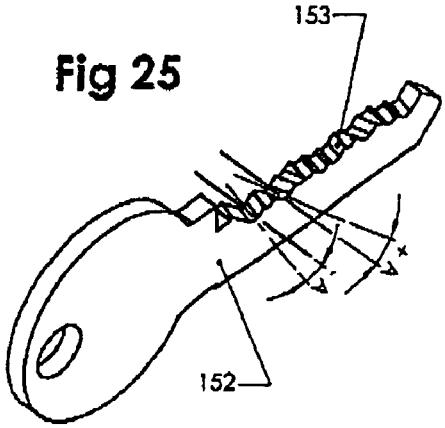
FIG. 25 shows, in a perspective view, a key blade cooperating with locking tumblers of the kind shown in FIGS. 24*a*, 24*b* and 24*c;*
Figure 26A:
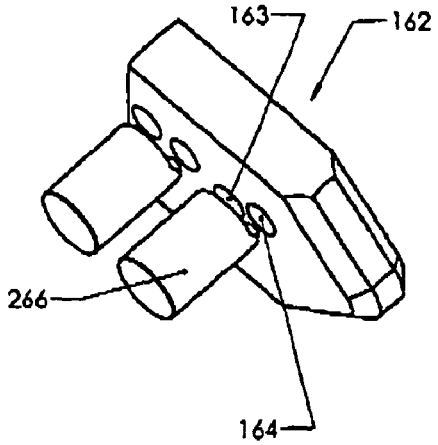
FIGS. 26*a*, 26*b* and 26*c* illustrate, in perspective and top views, a further embodiment with a row of tumblers being movable at right angle to the key blade.
Figure 26B:
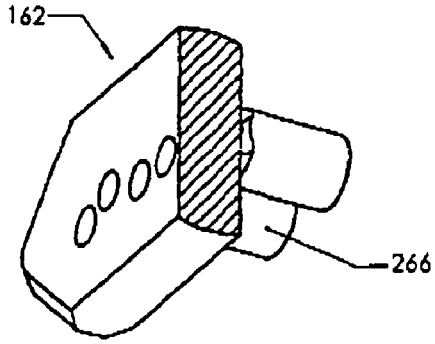
Figure 26C:
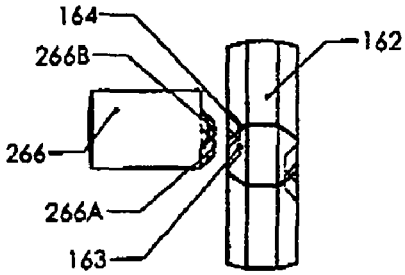

A further embodiment is shown in FIGS. 22*a*, 22*b*, 22*c* and 23, including a key blade 142 having pair-wise identical code patterns 143A, 143B and 144A, 144B, respectively, so that the key blade 142 can be turned upside down and still cooperate with the upper tumblers 246, 247. The latter are arranged in a longitudinal row, where one upper tumbler 246 (or a first set of upper tumblers) has a pair of neighbouring key contacting portions 246A, 246B on the longitudinal right hand side (cooperating with the code pattern 143A or 143B), whereas another upper tumbler 247 (or a second set of upper tumblers) is provided with neighbouring key contacting portions 247A, 247B on the longitudinal left hand side. A corresponding side view of the key blade 142 and the tumblers 246,247 is shown in FIG. 23.

The embodiment illustrated in FIGS. 24*a*, 24*b*, 24*c* and 25 includes a row of locking tumblers 256, each being guided for limited rotational movement, e.g. by means of a fin 257 (FIG. 24*b*) accommodated in a corresponding cavity (not shown) permitting such limited rotation. The tumblers 256 cooperate with a side bar 300, having transverse lugs 321, 322, etc. each fitting into a corresponding groove 258 along the body portion of each tumbler 256.

The corresponding key blade 152 (FIG. 25) has, at its upper edge portion, a code pattern 153, where the code portions for each tumbler 256 are specifically oriented at an angle (preferably not exceeding 15° relative to a plane at right angle to the key blade 152), so as to cause the corresponding tumbler 256 with its key contacting portions 256A, 256B to be located into a specific rotational position permitting the side bar to open the lock.

In a still further embodiment, illustrated in FIGS. 26*a*, 26*b* 26*c*, 27 and 28, the tumblers 266 in the longitudinal row are guided in associated chambers (not shown) for movement sideways and at right angle relative to the key blade 162. Each tumbler 266 has two neighbouring key contacting portions 266A, 266B each being formed as a conical lug extending from the end surface of the tumbler 266 towards the key blade.

Figure 27:
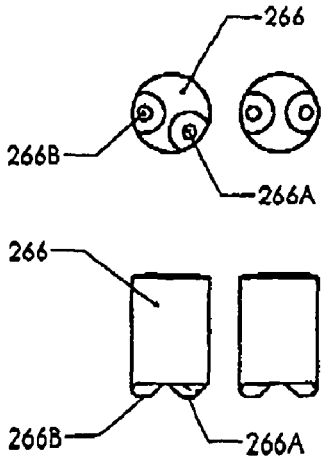
FIG. 27 shows, in end and side views, the two tumblers in FIGS. 26*a* and 26*b;*
Figure 28:
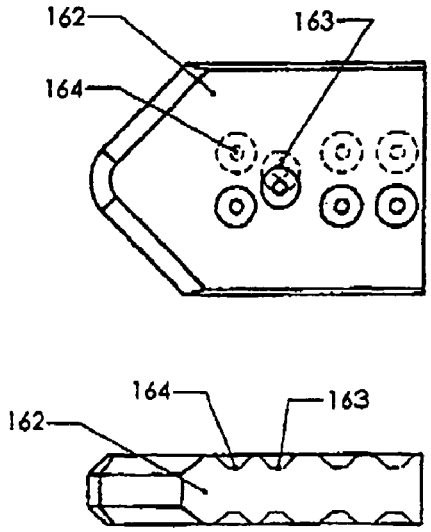
FIG. 28 shows, in elevational and top views, the key blade of FIGS. 26*a*, 26*b* and 26*c;*

As indicated in FIGS. 27 and 28, these conical lugs can be located along one or more (depending on the lug positions at the end portion of the tumbler pin)longitudinal rows forming the code pattern together with corresponding recesses 163, 164 in the key blade 162.

These recesses have generally different depths and are located along one or more longitudinal rows so as to register with the conical lugs of the associated tumblers. Like in the previous embodiments, some of the lugs 266A or 266B may not reach fully into the corresponding recess 163, 164, so the coding principles are the same as in the other embodiments. Also, in this embodiment as well, the key blade is symmetrical so as to be insertable upside down into the lock.

In all embodiments described above, the key contacting portions have smooth edges for possible sliding engagement with the longitudinal code pattern of the associated key. Such smooth edges can be achieved by making the contacting portions with a rounded shape, or by bevelled, sloping portions adjacent to the lowermost point of contact. This is normally important even for those contacting portions which will not make contact in the fully inserted position of the key blade, since these contacting portions will engage slidingly with the longitudinal code pattern when the key blade is being inserted into or pulled out from the key slot.

As mentioned above, it is possible that only a few or some of the tumblers (a subset) are provided with two or more key contacting portions.

Also, the neighbouring key contacting portions may be distributed in the longitudinal direction of the key plug and/or sideways. The latter possibility is illustrated e.g. in FIGS. 6*a* and 6*b*.

Figure 6A:
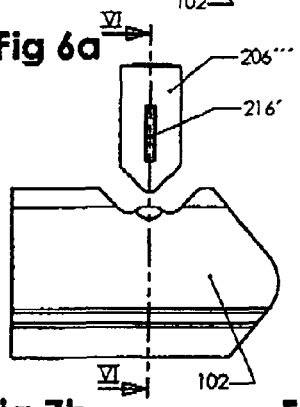
FIG. 6*a* is a side view of the end portion of the key blade of FIG. 4*d* and an associated locking tumbler.
Figure 6B:
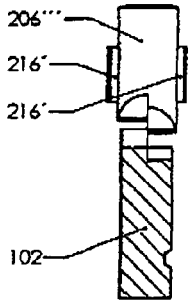
FIG. 6*b* is a cross-sectional view of the key blade and the locking tumbler of FIG. 6*a*, along the line VI-VI in FIG. 6*a;*

The locking tumblers may be rotatable along their axes, especially if they are rotationally symmetrical, e.g. as in FIGS. 8*a*, 8*b*, or the tumblers may be guided for limited rotational movement, e.g. as in FIGS. 7*a* through 7*f*, FIGS. 9 through 19 and in FIGS. 24*a*, 24*b*, 24*c* and 25. Such limited rotational movement may be achieved e.g. by guiding fins, as illustrated in FIGS. 6*a*, 6*b*, or in some other way. Especially, in case there are longitudinally parallel code patterns on the key blade, the associated locking tumblers (206''', FIGS. 6*a*, 6*b* and 236, FIGS. 20*a* 20*b*, 20*c*, 21, and 246, 247, FIGS. 22*a*, 22*b*, 22*c*, 23, and 266, FIGS. 26*a*, 26*b*, 26*c*, 27, 28 and 276, FIG. 29, and 286, 287, FIG. 30) should be non-rotatably guided, so as to secure a proper cooperation between the respective key contacting portions and the longitudinal code patterns.

Also, it is of course possible to have longitudinal code patterns (not shown) on both sides of the key blade, (e.g. of the kind illustrated in FIGS. 22*a*, 22*b*, 22*c* and 23 or in FIGS. 26*a*, 26*b*, 26*c*, 27 and 28), cooperating with associated rows of side locking tumblers (not shown) disposed on either side of the key slot, for making it possible to turn the key blade upside down. Then, the transversal finger may have to be located approximately on the middle of the body part rather than at the end portion thereof.

Figure 29:
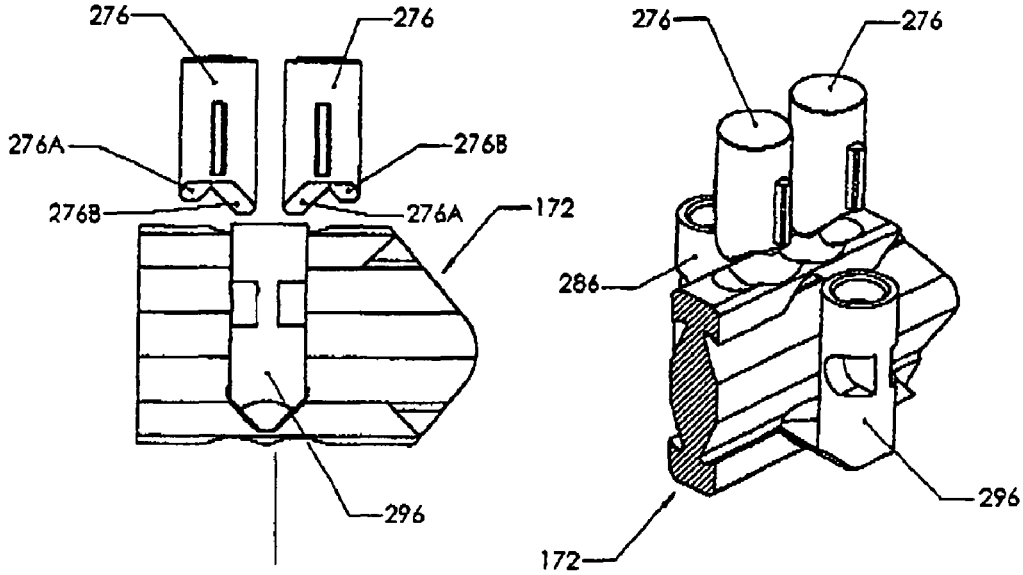
FIG. 29 shows, in side and perspective views, the end portion of a key blade cooperating with top tumblers as well as side tumblers on both sides of the key blade.

Another example of a symmetrical key blade, which can be turned upside down, is shown in FIG. 29. A row of upper pins 276 (only two pins are shown) cooperates with an upper edge portion of the key blade 172, whereas two rows of side tumbler pins 286, 296 are arranged on each side of the key slot (not shown) so as to cooperate with associated side code patterns (not specifically shown). The upper pins each have a rear lug 276A and a forward lug 276B like in the previous embodiments, and the code pattern at the top edge portion of the key blade 172 is cut out so as to cooperate with the upper pins 276A, B. The function is the same as in FIGS. 12 and 13*a* through 13*e*.

The various code patterns described above may be combined with each other in various ways. A final example is shown in FIG. 30 illustrating a key with a key blade 182 having at its upper edge portion two parallel, wave-like code patterns 183, 184 similar to the ones shown in FIG. 4*d* as well as a side code pattern 185 similar to the one (125) shown in FIGS. 15-19.

The upper code patterns 183, 184 co-operate with upper tumbler pins 286, 287 somewhat similar to the pins 246, 247 shown in FIGS. 22*a*, 22*b*, 22*c* and 23, whereas the side code pattern 185 co-operates with side tumblers (not shown) similar to those (216) shown in FIGS. 15-19.

Of course, in this embodiment, the key blade 182 is operable only when oriented as shown, and cannot be turned upside down.

Alternatively, it is possible to have upper code patterns 183, 184 only, and no side code pattern 185.

The longitudinal code patterns are preferably "wave-like" but may alternatively have some other configuration as long as they extend in the longitudinal direction and include code portions at varying levels or depths.

The keys or key blanks according to the invention are characteristic in that they include a longitudinal code pattern having a number of code portions generally exceeding the number of associated locking tumblers, there being one code portion for each key contacting portion of the tumblers, whether or not these code portions will actually make contact upon fully inserting the key blade into the lock. However, there should be at least one (but not necessarily all) of the neighbouring contacting portions of the tumblers that will contact a corresponding code portion of the longitudinal code pattern of the key blade.

Generally, the number of key code portions will be equal to the number of key contacting portions on the tumblers. However, in specific cases, these numbers may be slightly different, e.g. for the uppermost positions on the key blade, where a long key contacting portion on the tumbler may cooperate with an extremely shallow code portion on the key blade. It is also possible to have more code portions on the key than the total number of key contacting portions on the tumblers.

The longitudinal code pattern of the key blade may be disposed on the upper edge portion, as illustrated in FIGS. 1 through 3, on both edge portions, as indicated in FIG. 29, at a side wall of a longitudinal groove, as illustrated in FIGS. 15 through 18, or on some other part of the key blade, e.g. one or more shelves formed by a thicker base portion of the key blade, such as the one disclosed in the above-mentioned U.S. Pat. No. 5,640,865 (Widén) or as shown in FIGS. 20*a*, 20*b*, 20*c*, 21 and 22*a*, 22*b*, 22*c*, 23.

A key without a code pattern or having at least one code pattern already made thereon may serve as a key blank, the latter being transformed into a finished key upon cutting at least one further code portion into the key blank. Accordingly, the appended claims on "a key" are also intended to cover corresponding key blanks, the only difference being the final machining of a code pattern into the key blank.

In the illustrated embodiments, the code portions of the longitudinal code pattern are generally located at one of three different levels or depths. Of course, the number of such levels or depths may be different, including only one or two levels or depths or a larger number of vertical levels or depths.

Moreover, the cross-sectioned profile of the key blade may be varied by those skilled in the art, including various rectilinear longitudinal grooves on the side of the key blade and/or a thinner upper portion, as illustrated in FIG. 4*e*. As illustrated in FIGS. 7*e* and 7*f*, the key profile may comprise a relatively thin edge portion 102'*a* (FIG. 7*e*) which is entirely offset sideways from the base portion 102'*b* of the key blade 102' or oriented so as to extend obliquely (102"*a*, FIG. 7*f*) from one lateral side of the base portion 102"*b* of the key blade 102" to the other lateral side thereof. Such embodiments of the keys (and key blanks) will provide a slender and practically advantageous lock and key configuration, and will require tumbler pins adapted to contact the offset coded key portion, in particular at the outermost lateral side portion of the tumbler pin. Since they cannot operate conventional, conical or chisel pointed tumbler pins, such key profiles are of a new kind, being protected by the appended claims on a key and a key blank, respectively.

The tumbler pins do not have to be biassed by upper pins 207 and springs 209, as illustrated in FIGS. 1 through 3, but may be designed so as to lock or permit the key plug to rotate in the cylindrical bore of the housing in some other way. Also, it is possible two use master pins or wafers positioned axially between upper and lower top pins (not specifically illustrated).

The invention claimed is:

1. A lock and key system including locks of the kind comprising:

a housing (200) having a cylindrical bore (202), a cylindrical key plug (203) being rotatably journalled in said cylindrical bore, said key plug having a longitudinal key slot (204) and a number of locking tumblers (205) in a row along a key plug axis for locking the key plug against rotation in the cylindrical bore, at least a subset of said locking tumblers comprising a body part (206*a*) and an integral key sensing part (206*b*) for engagement with an associated key (100), said body part being mounted in an associated chamber (208) in said key plug for elevational movement therein along a tumbler axis in parallel with an axis of said associated chamber, and keys of the kind comprising:

a longitudinally extending key blade (102), which is insertable into said key slot of the key plug of an associated lock, said key blade having at least one longitudinal code pattern (103), including a number of code portions (104) for engaging with said integral key sensing part of said locking tumblers and making the key sensing part follow said longitudinal code pattern, when the key blade of said associated key is being inserted into the key slot, wherein said longitudinal code pattern of the key blade (102) comprises a longitudinal row of code concavities (104), and the integral key sensing part (206*b*) of each locking tumbler in said subset comprises at least two neighbouring key code contacting portions (210*a*, 211*a*) in the form of at least two projecting key code contact surfaces forming sensing portions on the locking tumbler adapted to mate with respective code concavities, said at least two projecting key code contact surfaces (210*a*, 211*a*) forming separate extreme ends of each locking tumbler and have tips on key code contact surfaces wherein the extreme ends with said tips are substantially parallel to each other and are mutually displaced from each other longitudinally along said key plug axis, at a mutual distance not exceeding ¾ of the distance between the central axes of two adjacent locking tumblers in said row, and each such key code contact surface being provided with smooth edges for possible sliding engagement with said longitudinal row of code concavities (104) in an associated key, when the latter is being inserted into said key slot, the number of code concavities in said longitudinal row in said associated key corresponding to the number of projecting key code contact surfaces of the locking tumblers in said row, said number of projecting key code contact surfaces and code concavities being at least twice the number of locking tumblers in said subset, and at least one of the tips of said projecting key code contact surfaces of each locking tumbler in said subset only engaging with a corresponding code concavity in said associated key and being elevationally and rotationally positioned at an exact code location upon fully inserting said key into said key slot.

2. A cylinder lock and key system as defined in claim 1, comprising at least a first lock and a second lock, which are different from each other, and at least a first key (102A) and a second key (102B) which are likewise different from each other, said first key operating less than the total number of locks and the second key operating more locks than the first key, wherein both of said first and second keys have a number of code concavities which will not make contact with the corresponding key code contacting surface of the associated locking tumbler of the lock, upon full insertion of the respective key so as to operate the respective lock or locks.

3. A cylinder lock of the kind comprising a housing (201) having a cylindrical bore (202), a cylindrical key plug (203) being rotatably journalled in said cylindrical bore, said key plug having a longitudinal key slot and a number of locking tumblers (205) in a row along a key plug axis for locking the key plug against rotation in the cylindrical bore, at least a subset of said locking tumblers comprising a body part (206*a*) and an integral key sensing part (206*b*) for engagement with a longitudinal code pattern of an associated key (100), said body part being mounted in an associated chamber (208) in said key plug for elevational movement therein along a tumbler axis in parallel to the axis of said associated chamber, wherein the integral key sensing part (206*b*) of each locking tumbler in said subset comprises at least two neighbouring key code contacting portions (210*a*, 211*a*), in the form of at least two projecting key code contact surfaces forming sensing portions on the locking tumbler adapted to mate with respective code concavities, said at least two projecting key code contact surfaces (210*a*, 211*a*) forming separate extreme ends of each locking tumbler and have tips on key code contact surfaces wherein the extreme ends with said tips are substantially parallel to each other and are mutually displaced from each other longitudinally along said key plug axis, at a mutual distance not exceeding ¾ of the distance between the central axes of two adjacent locking tumblers in said row, and each such projecting end lug being adapted to engage with a longitudinal row of code concavities in said associated key when the key is being inserted into said key slot, the number of projecting key code contact surfaces being at least twice the number of locking tumblers in said subset, and at least one of the tips of said projecting key code contact surfaces being dimensioned to only engage and cooperate operatively with a corresponding code concavity in said associated key and being elevationally and rotationally positioned at an exact code location upon fully inserting said key into said key slot.

4. A cylinder lock as defined in claim 3, wherein said projecting key code contact surfaces (210*a*, 211*a*) are displaced from each other also sideways relative to said key plug axis.

5. A cylinder lock as defined in claim 3, wherein said body part of each locking tumbler (256) is guided for limited rotational movement.

6. A cylinder lock as defined in claim 5, wherein said body part (206''') is non-rotatably guided.

7. A cylinder lock as defined in claim 3, wherein said integral key sensing part with said projecting key code contact surfaces (220*a*, 221*a*) is disposed on a finger (219) which extends transversely from said body part (217).

8. A cylinder lock as defined in claim 7, wherein the body part (217) is guided for limited rotational movement, said projecting key code contact surfaces (220*a*, 221*a*) being adapted for possible sliding engagement with a longitudinal code pattern (125) disposed on at least one side of an associated key (122).

9. A cylinder lock as defined in claim 7, wherein the body part (217) is non-rotatably guided.

10. A cylinder lock as defined in claim 3, wherein said projecting key code contact surfaces (220*a*, 221*a*; 266A, 266B) are constituted by lugs extending from an end portion of said locking tumbler (216; 266).

11. A cylinder lock as defined in claim 10, wherein said lugs (210*a*, 211*a*; 266A, 266B) extend in a direction being parallel to said tumbler axis.

12. A cylinder lock as defined in claim 3, wherein said locking tumbler (266) with said projecting key code contact surfaces (266A, 266B) is oriented so as to be movable at right angle to a central plane of said key slot.

13. A cylinder lock as defined in claim 12, wherein said projecting key code contact surfaces (266A, 266B) are located at different levels in relation to said key slot.

14. A cylinder lock as defined in claim 3, wherein said at least two projecting key code contact surfaces (237A, 237B) are located on one longitudinal side of said key slot.

15. A cylinder lock as defined in claim 14, wherein there are also at least two projecting key code contact surfaces (247A, 247B) located on an opposite longitudinal side of said key slot.

16. A locking tumbler (206) in a cylinder lock having a key plug which is rotatably journalled in a cylindrical bore of said lock and having a number of locking tumblers arranged in a row along the plug axis, said locking tumbler comprising a body part and an integral key sensing part adapted to engage with a longitudinal code pattern of an associated key, wherein:

said integral key sensing part (206*b*) of said locking tumbler is provided with at least two neighbouring key code contacting portions (210*a*, 211*a*) in the form of at least two projecting key code contact surfaces forming sensing portions on the locking tumbler adapted to mate with respective code concavities, said at least two projecting key code contact surfaces (210*a*, 211*a*) forming separate extreme ends of each locking tumbler and have tips on key code contact surfaces wherein each tip is disposed in a substantially perpendicular direction relative to a longitudinal axis of each locking tumbler on each key sensing part wherein the extreme ends are substantially parallel to each other and being mutually displaced from each other longitudinally along said key plug axis and being confined within a limited region at a mutual distance not exceeding ¾ of the distance between the central axes of two adjacent locking tumblers in said row, said neighbouring lugs each being provided with smooth edges for possible sliding engagement with said longitudinal code pattern of said associated key, and at least one of the tips of said projecting key code contact surfaces being dimensioned to only engage and cooperate operatively with a corresponding code portion of said longitudinal code pattern of said associated key and being elevationally and rotationally positioned at an exact code location upon fully inserting said key into said key slot.

17. A key (100) comprising a longitudinally extending key blade (102), which is insertable into a key slot in a rotatable key plug of an associated lock with a number of locking tumblers arranged in a row along the axis of said key plug, the key blade having at least one longitudinal code pattern (103) for engagement with a key sensing part of at least a subset of said locking tumblers in said row, wherein:

said longitudinal code pattern includes a number of code concavities (104) of varying depths for possible engagement with a corresponding one of at least two neighbouring key code contacting portions in the form of at least two projecting key code contact surfaces forming sensing portions on the locking tumbler adapted to mate with respective code concavities and being provided on each key sensing part of said locking tumblers in said subset, said at least two projecting key code contact surfaces forming separate extreme ends of each locking tumbler and having tips on key code contact surfaces wherein each tip is disposed in a substantially perpendicular direction relative to a longitudinal axis of each locking tumbler wherein the extreme ends are substantially parallel to each other, said key sensing part of said locking tumblers being mutually displaced from each other longitudinally along said key plug axis when the key blade is being inserted into said key slot, said number of code concavities corresponding to the number of longitudinally spaced projecting key code contact surfaces of the locking tumblers in said subset, said number of code concavities being at least twice the number of locking tumblers in said subset, and the code concavities of said longitudinal code pattern being formed so that at least one of the tips of said neighbouring key code contacting portions will only contact a corresponding code concavity of said longitudinal code pattern of the key blade upon fully inserting said key into said key slot.

18. A key as defined in claim 17, wherein the longitudinal code pattern (103) is disposed on at least one longitudinal edge portion of said key blade (102).

19. A key as defined in claim 18, wherein the longitudinal code pattern comprises two separate portions (110, 111, 112'; 183, 184) extending longitudinally in parallel and adjacent to each other on said longitudinal edge portion of said key blade (102; 182).

20. A key as defined in claim 18, wherein said longitudinal edge portion (102'*a*; 102"*a*) is thinner than a base portion (102'*b*; 102"*b*) of the key blade (102; 102").

21. A key as defined in claim 20, wherein said thinner longitudinal edge portion (102'*a*) is entirely offset sideways relative to said base portion (102'*b*).

22. A key as defined in claim 20, wherein said thinner longitudinal edge portion (102"*a*) is oriented so as to extend obliquely upwardly from said base portion (102"*b*).

23. A key as defined in claim 18, wherein said code pattern at said longitudinal edge portion of the key blade (152) comprises cuts oriented at different angles relative to a plane oriented perpendicularly to the key blade (152).

24. A key as defined in claim 17, wherein a longitudinal code pattern (125; 163,164; 185) is disposed on at least one side portion of said key blade (122; 162; 182).

25. A key as defined in claim 24, wherein the longitudinal code pattern (133A, 133B, 135A, 135B) is disposed on a shelf surface at said side portion.

26. A key as defined in claim 24, wherein a wave-like code pattern (125; 185) is disposed in a longitudinal groove in said side portion.

27. A key as defined in claim 17, wherein the longitudinal code pattern (103) comprises tumbler contacting portions being distributed longitudinally into groups (110, 111, 112) of neighbouring tumbler contacting portions, each such group including at least two tumbler contacting portions (110, 111), at least one of said neighbouring tumbler contacting portions being located so as to actually make contact with a corresponding key code contacting portion of an associated tumbler upon fully inserting the key into said key slot.

28. A key as defined in claim 27, wherein each of said neighbouring tumbler contacting portions comprises a smoothly formed concavity (110, 111).

29. A key as defined in claim 28, wherein said smoothly formed concavities are located at a predetermined number of vertical levels or depths, the vertical dimension being defined at right angle to the longitudinal direction of the key.

30. A key as defined in claim 27, wherein said neighbouring tumbler contacting portions (110, 111, 112) comprise a mid portion (112) and two adjoining portions (110, 111) on each longitudinal side of said mid portion.

31. A key as defined in claim 30, wherein said mid portion is constituted by a recess (112).

32. A key as defined in claim 30, wherein said adjoining portions (110, 111) are located on the same vertical level or depth, the vertical dimension being oriented at right angle to the longitudinal direction of the key.

33. A key as defined in claim 17, wherein the key blade (132; 142) is symmetrical so as to enable insertion thereof into an associated lock with the blade oriented in any one of two positions turned 180° relative to each other.

34. A key blank, comprising a key blade (102; 102") as defined in claim 17, wherein a longitudinally extending portion (102'*a*; 102"*a*) of the key blade is shaped so as to permit the forming of a code pattern into the key blade.

35. A key blank as defined in claim 34, wherein the key blade includes a longitudinal edge portion (102'*a*; 102"*a*) being offset or extending obliquely in relation to a base portion of the key blade (102'; 102").

* * * * *